US005331988A

United States Patent [19]

Harmon

[11] Patent Number: 5,331,988

[45] Date of Patent: Jul. 26, 1994

[54] WALKING CANE WITH ALTERNATIVE DECORATIVE COVER

[76] Inventor: Diane M. Harmon, 10338 Longford Dr., South Lyon, Mich. 48178

[21] Appl. No.: 908,068

[22] Filed: Jul. 6, 1992

[51] Int. Cl.[5] ..... A45B 1/00

[52] U.S. Cl. ..... 135/65; 135/66

[58] Field of Search ..... 135/65, 66, 34.2; 160/DIG. 6, 330, 38; 211/125.1, 123; 52/311; 4/608

[56] References Cited

U.S. PATENT DOCUMENTS

| | | | |
|---|---|---|---|
| 457,160 | 8/1891 | Killenberger | 135/66 |
| 2,509,074 | 5/1950 | Reiley | 135/66 X |
| 2,561,228 | 7/1951 | Richey | 135/65 |
| 2,802,479 | 8/1957 | Hickman | 135/65 |
| 4,027,687 | 6/1977 | McGowan | 135/66 |
| 4,556,075 | 12/1985 | Hoffman | 136/65 |
| 4,760,929 | 8/1988 | Fedorchak | 211/123 |
| 4,884,730 | 12/1989 | Carpenter | 135/66 X |

FOREIGN PATENT DOCUMENTS

| | | | |
|---|---|---|---|
| 1912778 | 9/1970 | Fed. Rep. of Germany | 135/66 |
| 0371637 | 5/1939 | Italy | 135/34.2 |
| 0019338 | of 1903 | United Kingdom | 135/34.2 |

*Primary Examiner*—Carl D. Friedman
*Assistant Examiner*—Lan M. Mai

[57] ABSTRACT

A walking cane is provided with a removable decorative cover which may be changed at will by the user to reflect changes in mood or attire.

3 Claims, 1 Drawing Sheet

WALKING CANE WITH ALTERNATIVE DECORATIVE COVER

BACKGROUND OF THE INVENTION

1. Field of the Invention

The present invention pertains to the field of walking canes. More particularly, the present invention pertains to walking canes having a decorative cover which may be changed at will by the user to reflect changes in mood or attire.

2. Description of the Related Art

Walking canes are as old as mankind itself. Throughout ages, walking canes have been used by the aged, the infirm, and the incapacitated, not to mention, at times, dignitaries such as kings, queens, and chiefs of state. While simple, unadorned canes have normally sufficed to provide their intended function, intricately carved and otherwise decorated canes were utilized by the wealthy or those with the requisite skills to create them.

The use of decorative canes has been of great psychological benefit to those stricken with dehabilitating diseases or those suffering from accidental loss of limb. However, to change the nature of the particular decorative effect, the person desirous of such a change would have to purchase a new cane, or recarve, repaint, or otherwise redecorate an existing one.

SUMMARY OF THE INVENTION

The present invention pertains to walking canes in which the exterior appearance may by easily and inexpensively changed to reflect the mood or attire of the owner. The walking canes of the subject invention comprise a substantially linear cylinder of suitable length for use as a walking cane, and a decorative plastic sleeve having a length which is a substantial fraction of the overall cane length, and which in cross-section comprises a nonclosed cylinder or overlapping coil whose mean diameter is less than or equal to the diameter of the walking cane, removable mounted onto the linear portion of the walking cane.

DESCRIPTION OF THE PREFERRED EMBODIMENTS

Figure 1:
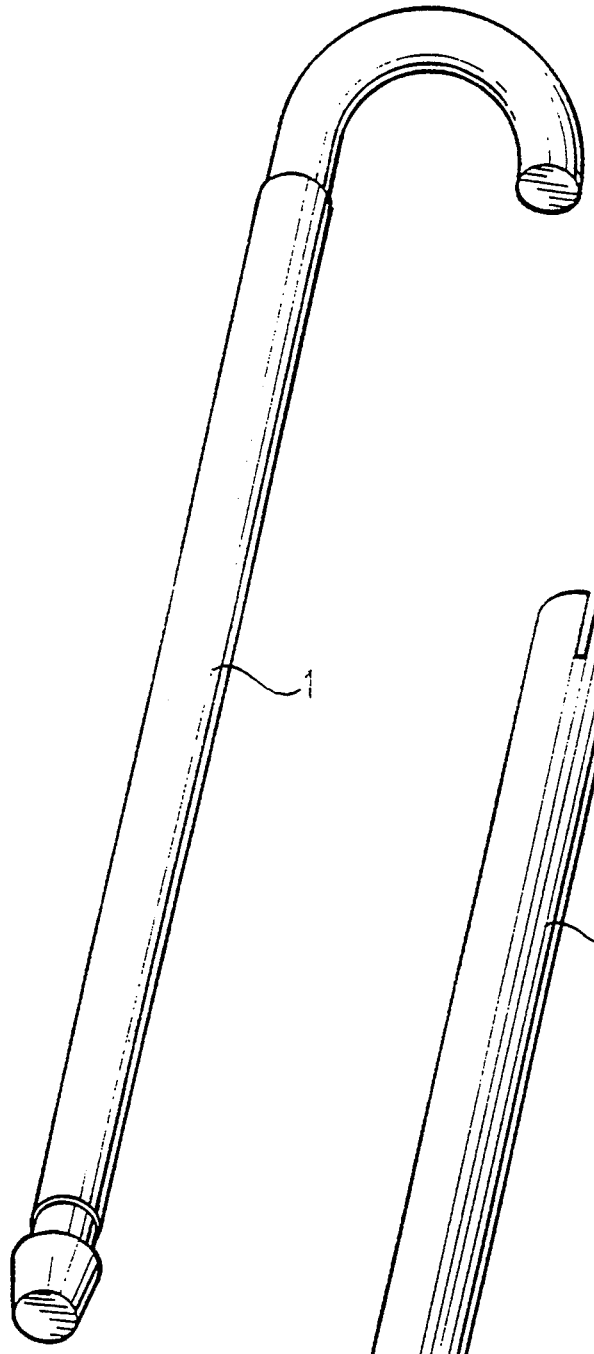
FIG. 1 is a drawing of a cane having a cane cover sleeve reversibly mounted thereon.
Figure 2:
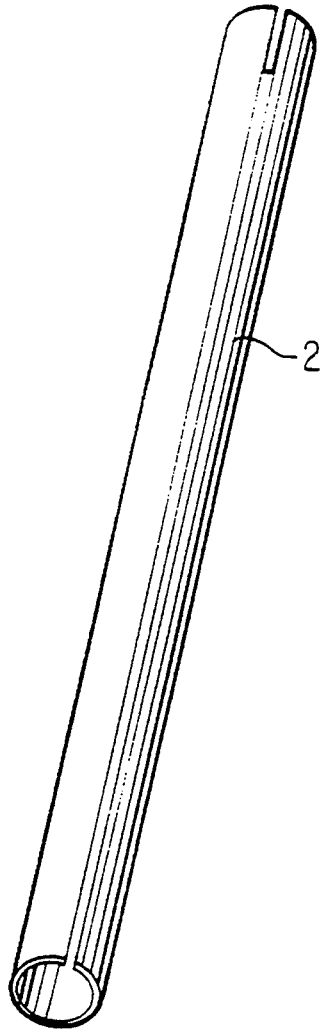
FIG. 2 shows a cane cover sleeve having a non-closed cylindrical cross-section.
Figure 3:
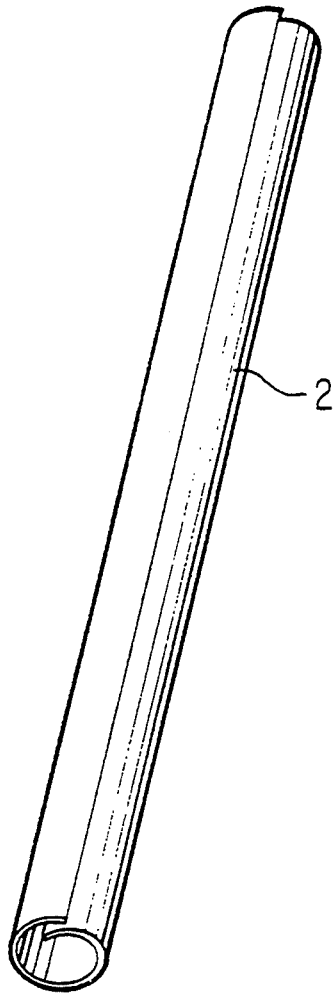
FIG. 3 shows a cane cover sleeve having a non-closed coil cross-section.

The decorative sleeve may be further described in relation to FIGS. 1, 2, and 3, which are self explanatory. In use, the sleeve is expanded along the slit (2) and slipped over the linear portion of the cane (1). The inner circumference of the sleeve should be the same or greater than the circumference of the cane exterior. The shape memory of the plastic used to prepare the sleeve will ensure that the sleeve fit tightly against the linear portion of the cane.

By the term "substantially linear portion extending for a substantial fraction of the total length of the cane" is meant a portion of the cane having substantially a constant diameter, extending over a length which is at least a substantial fraction of the overall cane length, i.e.

60 percent or more, preferably 75 percent, or more of the overall cane length. By the term "removably mounted" is meant that the plastic sleeve is mounted to the cane by virtue of the mean inside diameter of the sleeve being less than or substantially equal to the outside diameter of the cane, and being removable and replaceable by hand, without resort to the use of tools or other equipment.

By the term "whose length is a substantial fraction of the length of the linear portion of said cane" is meant that the sleeve length is greater than 50 percent of the length of the linear portion of the cane, preferably 75 percent or greater, and most preferably substantially the same length as that of the length of the linear portion of the cane.

By the term "non-closed cylinder" is mean that the sleeve is a cylinder or cylindrical coil having a slit along its length such that the sleeve may easily be removed or mounted to the cane. Such non-closed sleeves are illustrated in FIGS. 2 and 3. By the term "resilient plastic" is meant a polymeric material which has sufficient resilience, or flexibility that it may be expanded along the non-closed portion of the sleeve without permanently deforming.

Preferably, the cane cover is made of polystyrene, however other plastics such as the polyesters, polypropylenes, polyacrylates, and the like can also be used. The mean diameter of the cover is between $\frac{1}{2}''$ and $1\frac{1}{4}''$ in the unexpanded mode (not applied to a cane), preferably between $\frac{5}{8}''$ and $\frac{3}{4}''$. The length is nominally between 28 and 32 inches, but may be shorter or longer as required. As the sleeves are relatively inexpensive, they may conveniently be manufactured somewhat longer than will ordinarily be necessary, and cut to length by the user. The manufacture of such sleeves is well known to those skilled in the art of plastics fabricating and extrusion and thus need not be described further.

I claim:

1. A cane for walking, comprising a) one substantially linear portion, cylindrical in cross section, said linear portion extending for a substantial fraction of the overall length of said cane, and said portion of cylindrical cross section having an outer circumference and an outer diameter; b) a decorative sleeve removably mounted upon the linear portion of said cane (a), the length of said sleeve being a substantial fraction of the length of said linear portion (a) of said cane, wherein said sleeve comprises a non-closed cylinder of resilient plastic having one and only one slit along its length, and having an inner circumference and a mean inside diameter, to fit snugly against the linear portion (a) of said cane, wherein the mean inside diameter of said sleeve is less than the outside diameter of said cane.

2. The cane of claim 4 wherein the inner circumference of said removable decorative sleeve is greater than 90 percent of the outer circumference of the linear portion of said cane, and whose mean inside diameter is substantially equal to or less than the outside diameter of said linear portion of said cane.

3. The cane of claim 2 wherein the removable sleeve has a cross-sectional shape of a coil, said cross-sectional shape viewed in the plane orthogonal to the cylindrical axis of the sleeve, and has an inner circumference which is greater than the outer circumference of the liner portion of said cane.

* * * * *